United States Patent [19]

Barton

[11] Patent Number: 4,910,778

[45] Date of Patent: Mar. 20, 1990

[54] SIGNAL ENHANCEMENT PROCESSOR FOR STEREO SYSTEM

[76] Inventor: Geoffrey J. Barton, Upton Lodge Cottage, Reading Rd., Upton near Didcot, Oxon, Oxford 1194P, England

[21] Appl. No.: 109,553

[22] Filed: Oct. 16, 1987

[51] Int. Cl.[4] ..... H04S 1/00

[52] U.S. Cl. ..... 381/1

[58] Field of Search ..... 381/1, 17, 18, 19

[56] References Cited

U.S. PATENT DOCUMENTS

| | | | |
|---|---|---|---|
| 3,236,949 | 2/1966 | Atal et al. . | |
| 3,246,081 | 4/1966 | Edwards . | |
| 3,249,696 | 5/1966 | Van Sickle . | |
| 3,281,533 | 10/1966 | Pflager et al. . | |
| 3,564,162 | 2/1971 | Bauer . | |
| 3,725,586 | 4/1973 | Iida . | |
| 3,849,600 | 11/1974 | Ohshima . | |
| 3,856,992 | 12/1974 | Cooper . | |
| 3,885,101 | 5/1975 | Ito et al. . | |
| 3,887,770 | 6/1975 | Takahashi . | |
| 3,892,624 | 7/1975 | Shimada . | |
| 3,943,293 | 3/1976 | Bailey . | |
| 4,118,599 | 10/1978 | Iwahara et al. . | |
| 4,121,059 | 10/1978 | Nakabayashi . | |
| 4,139,728 | 2/1979 | Haramoto . | |
| 4,149,036 | 4/1979 | Okamoto et al. . | |
| 4,191,852 | 3/1980 | Nishikawa . | |
| 4,192,969 | 3/1980 | Iwahara . | |
| 4,218,585 | 8/1980 | Carver . | |
| 4,239,937 | 12/1980 | Kampmann . | |
| 4,303,800 | 12/1981 | DeFreitas . | |
| 4,309,570 | 1/1982 | Carver . | |
| 4,394,537 | 7/1983 | Shima et al. | 381/1 |
| 4,495,637 | 1/1985 | Bruney . | |
| 4,567,607 | 1/1986 | Bruney et al. . | |
| 4,603,429 | 6/1986 | Carver . | |

FOREIGN PATENT DOCUMENTS

| | | | |
|---|---|---|---|
| 0030300 | 2/1983 | Japan | 381/1 |
| 467481 | 7/1975 | U.S.S.R. | 381/1 |
| 488366 | 10/1975 | U.S.S.R. | 381/1 |
| 552731 | 3/1977 | U.S.S.R. | 381/1 |
| 394325 | 6/1933 | United Kingdom . | |

OTHER PUBLICATIONS

Chamberlin, Musical Applications of Microprocessors, 1980, pp. 447–452.

Gerzon, M. A., "Design of Ambisonic Decoders for Multispeaker Surround Sound", presented at the 58th Audio Engineering Society Convention, N.Y., Nov. 4, 1977.

Gerzon, Michael, "Stereo Shuffling—New Approach—Old Technique", *Studio Sound,* Jul. 1986, pp. 122–130.

*Primary Examiner*—Forester W. Isen

*Attorney, Agent, or Firm*—Larry A. Jackson

[57] ABSTRACT

The enhancement processor disclosed herein includes left and right channels through which the components of the stereo signal are fed, and a side channel that receives a difference signal derived from the main left and right channel signals. The side channel difference signal is shifted in quadrature, (e.g. + or −90°) relative to the main channels of the processor, adjusted by a variable gain control, low pass filtered and added back into the main left and right channels prior to the stereo outputs. Further enhancement is achieved in the processor by combining with the above effect, a gain adjusted anti-phase cross-feed between the main left and right channels to produce an image-widening characteristic that compensates for some undesired image alteration resulting from the quadrature shifted side channel.

16 Claims, 4 Drawing Sheets

SIGNAL ENHANCEMENT PROCESSOR FOR STEREO SYSTEM

BACKGROUND

The present invention concerns audio signal processing and particularly relates to circuits and systems for enhancing the sound qualities in stereo systems, and also for overcoming certain signal degradation problems that occur passing monaural signals through the processor and in combining stereo source signals into monaural at the output of the processor.

When the spatial signal components picked up by stereo microphoning are mixed in the usual manner, i.e., by simply summing the left and right source of signals in accordance with a balance control called a "panpot", it is believed that some of the signal information is hidden by the more dominant phase opposed (i.e., 180° opposite) components in the source signals. It is an object of this invention to process the source signals in a way that enhances the signal information when recording, broadcasting and reproducing stereo signals so that more of the qualities of the stereo source are perceived by the listener.

It is another object of the present invention to provide a processor for the above purpose, which also has the advantage of being compatible when combining certain types of encoded stereo, such as Dolby MP, into a monaural signal, and to pass without degradation monaural source signals, such as required in certain broadcasting and recording applications.

SUMMARY OF THE INVENTION

To enhance the sound images of a stereo signal, a signal processor receives input left and right stereo signal components that are passed through main left and right signal channels, and develops a difference signal by subtracting the two input signal components which is then fed to a side channel where it is phase shifted and added back into the main channels. The side channel difference signal is shifted in quadrature (e.g. + or −90°), relative to the main channels of the processor. In the preferred embodiment, the side channel signal is also low pass filtered and adjusted in gain by a variable user control. The quadrature phase shift of the difference signal, when combined back into the main channels seems to add or recover certain signal information that may be otherwise lost.

Further enhancement is achieved in the preferred processor embodiment by combining the above quadrature shifted side channel difference signal with gain adjusted anti-phase cross-feed between the main left and right channels. The combined effects produce both image enhancement as described above together with image-widening to compensate for a subjective perception of image narrowing attributed to the signal information made more distinctive by the side channel.

The disclosed processor is also useful for minimizing signal degradation due to signal loss from cancellation effects when combining certain encoded stereo signals into a monaural output, and when passing a monaural signal through the processor as is often required for compatible broadcasting and recording applications.

BRIEF DESCRIPTION OF THE DRAWINGS

To provide a complete disclosure of the invention, reference is made to the appended drawings and following description of the currently preferred embodiments and alternatives thereto.

DETAILED DESCRIPTION OF PREFERRED AND ALTERNATIVE EMBODIMENTS

Figure 1:
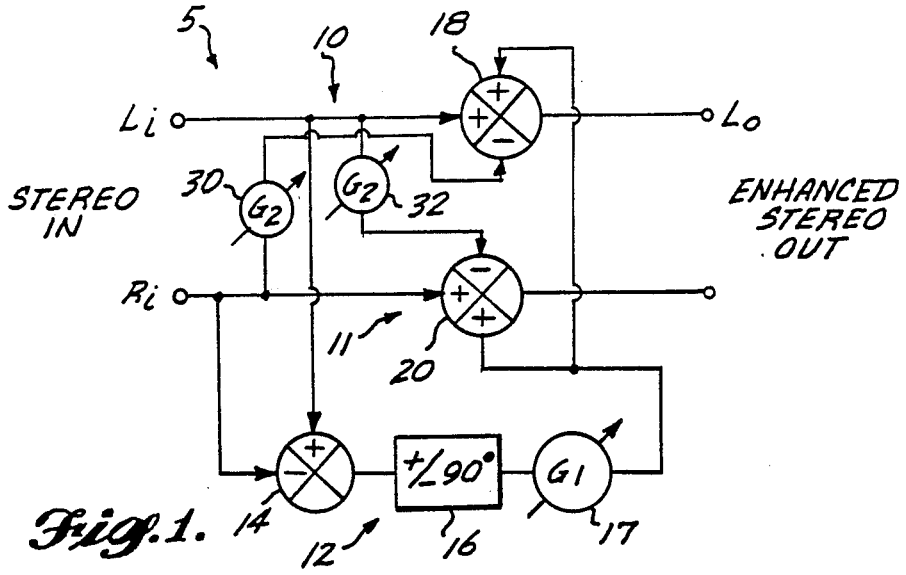
FIG. 1 is a generalized block diagram of the processor in accordance with one embodiment of the invention showing, in addition to the main left and right stereo signal channels, a side channel for developing the quadrature shifted difference signal.

The processor 5 of the invention, shown in a generalized and simplified form in FIG. 1, provides for enhancing the subjective qualities of the stereo image associated with spatially derived left and right signal components applied to the inputs Li and Ri, with the resulting enhanced stereo image signal being passed to outputs Lo and Ro.

The processor 5 shown in FIG. 1, has in addition to the left and right main signal channels 10 and 11, a third or side channel 12 which when added to the main channels enhances the sound image reproduced from the stereo output signal components Lo and Ro. The side channel 12 is provided by taking the difference of the left and right signals Li and Ri by means of a differencing network 14 connected to channels 10 and 11 as indicated. A relative quadrature phase shift of substantially + or −90° is then introduced in channel 12 by phase shifting network 16 in series with the output of differencing network 14. The quadrature shifted difference signal is then adjusted in gain, preferably by a manually operated gain control G1 indicated at 17 in side channel 12, and the resulting signal is then combined back into the left and right main signal channels 10 and 11 by means of combining or summing networks 18 and 20. The side channel signal in this embodiment is jointly combined back into the main channels with the same phase sense by networks 18 and 20 as indicated in FIG. 1.

The quadrature phase shift, which is + or −90° but may vary by 30° either side of 90°, is believed to distribute the difference signal information into a relative phase position not dominated by the 180° phase opposed relationship of the primary left and right signal components. By so doing, the quadrature shifted difference signal is believed to make greater use of the available phase circle enabling this signal information to be more readily perceived by the listener.

The addition of the side channel 12 does have, in some cases, a subjectively undesirable side effect which may be perceived as a kind of narrowing of the sound image. To compensate for this narrowing effect the processor 5 of FIG. 1 is also provided with antiphase cross-feed, known per se, and provided in this embodiment by a pair of manually adjustable gain controls G2 indicated at 30 and 32 and connected respectively to the phase inverting inputs of combining networks 18 and 20.

Thus, in operation, the gain control G2 at 30 provides for cross-feeding a variable amount of the right signal component with relative phase inversion into the left main channel 10 at combining network 18. Similarly, variable gain G2 indicated at 32 provides opposed phase cross-feed of a portion of the left channel signal Li to the right main channel 11 at the negative phase input of combiner 20.

As described more completely hereinafter, as the amount of gain in the side channel 12 is increased by adjustment of gain control G1 provided at 17 to enhance the resulting image, any subjective narrowing of the resulting image can be compensated for by introducing a variable amount of antiphase cross-feed by adjusting the G2 controls at 30 and 32. When the gain controls G1 at 17 and G2 at 30 and 32 are adjusted to reduce the associated signal path to 0 amplitude, then the processor 5 functions to throughput the stereo signals without enhancement or other modification.

Figure 2:
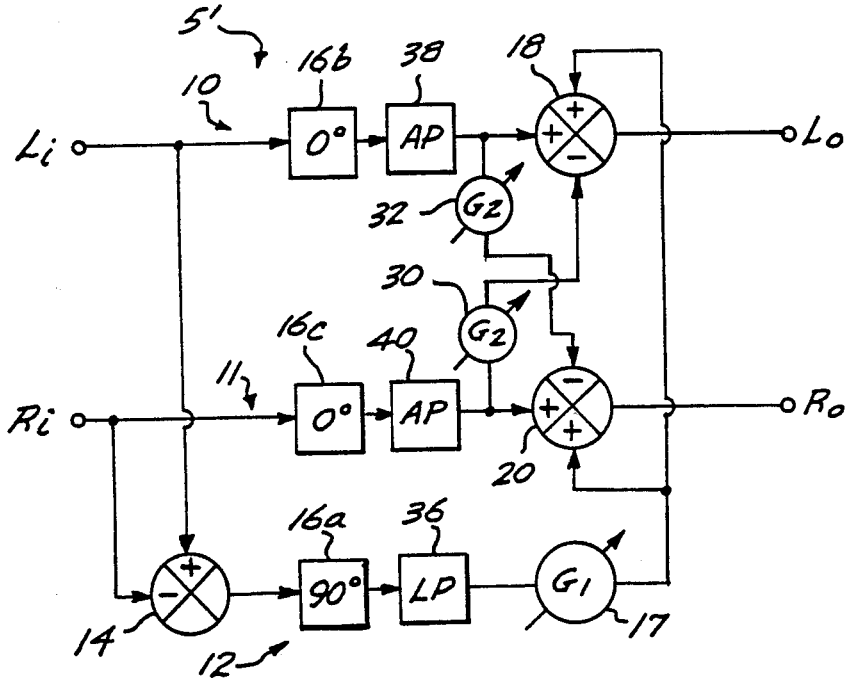
FIG. 2 is also a generalized block diagram similar to FIG. 1 but showing a somewhat different configuration and the addition of a low pass filter in the side channel.

FIG. 2 shows a processor 5' being a somewhat more refined embodiment of processor 5 of FIG. 1 in that a low pass filter 36 is placed in the signal path of side channel 12. Furthermore, the relative quadrature phase shift in the side channel is produced by the combined relative effects of phase shifting filter **16*a* in channel 12, relative to phase shifts in filters 16*b* and 16*c* in channels 10 and 11. As indicated, the filters 16*b* and 16*c* of the main left and right channels 10 and 11 represent a relative phase shift of channel 12. Additionally, the main left and right channels 10 and 12 are provided with identical all pass filters 38 and 40 which are designed in a manner well known in the art to compensate for any phase shift introduced by low pass filter 36 in side channel 12. As in the case of the FIG. 1 embodiment, the net effect of the phase shifts indicated at filters 16*a*, 16*b* and 16*c* and the filters 36, 38 and 40 is to introduce a net relative phase shift of substantially 90° lagging in side channel 12 relative to the main left and right channels 10 and 11. This 90° or quadrature shift is substantially independent of frequency over the audio spectrum of from about 20 Hz to 20 kilo Hz. The relative phase shifts of filters 16*a*, 16*b*, and 16*c* can in practice be incorporated into filters 36, 38 and 40** or into other components of the respective channels so long as the relative quadrature phase shift is maintained.

While the precise frequency response characteristics of low pass filter 36 can be varied, preferably this filter passes frequencies below about 2 kilo Hz although the range of pass frequencies can vary above or below this cut off frequency by about 1 octave. By using a low pass filter in the enhancement side channel, sound effects associated with quickly decaying transients and harmonic partials, including reverberation returns and other discrete transient sounds, are recovered with surprising clarity and spatial positioning.

Figure 3:
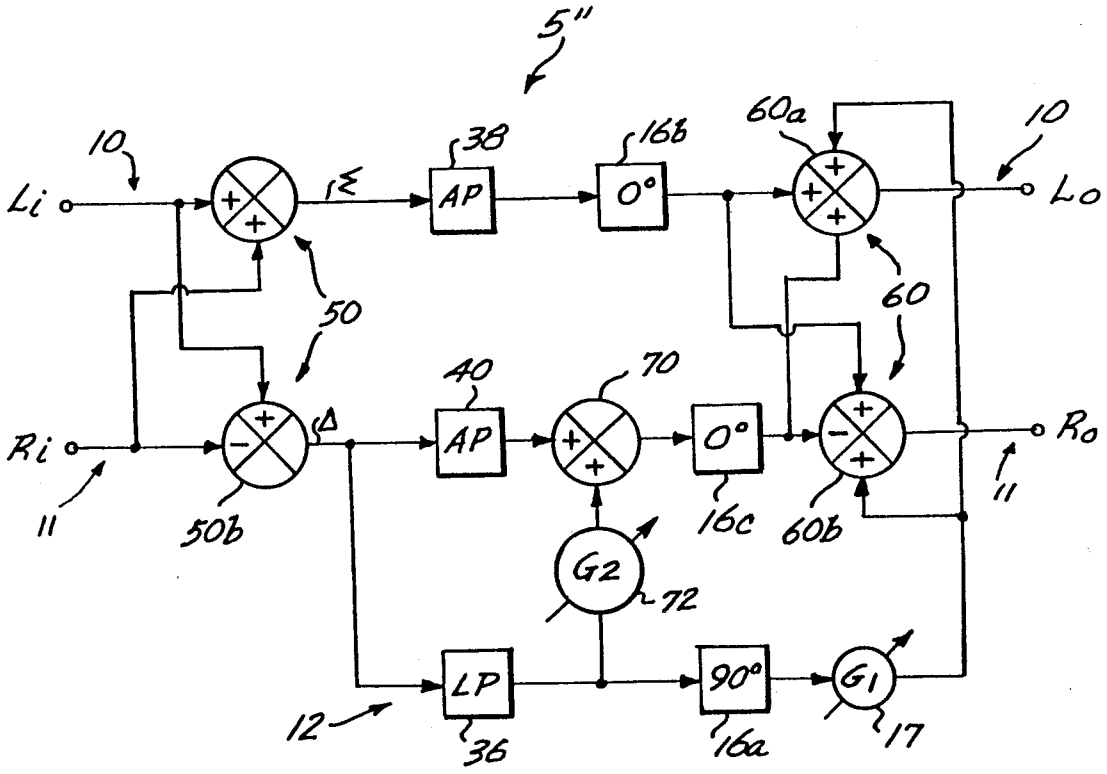
FIG. 3 is a further generalized block diagram again similar to FIGS. 1 and 2 but showing a preferred configuration of the processor according to he invention in which the difference signal for the side channel is derived from the difference output of a cross-channel sum and difference network at the input of the processor.

A further and still more refined embodiment is shown in FIG. 3. Here, the difference taking network for developing the side channel 1 is provided by a difference or delta (Δ) output of a summing and differencing network 50 provided adjacent the input of processor 5''. The input summing and differencing network 50 is a companion to an output summing and differencing network 60 that is cascaded in the main signal channels with network 50, in a manner known per se, to restore the left and right hand senses to the stereo signal components at outputs Lo and Ro. The function of networks 50 and 60 is explained in greater detail in connection with FIG. 4 below, but in general provides for recovering middle and side sound images from the stereo components. Networks 50 and 60 each contain a pair of multi-input summing and differencing networks **50*a*, 50*b*, and 60*a*, 60*b*. Interposed between the summing and differencing networks 50 and 60, is the side channel 12 which includes low pass filter 36 in series with the relative phase shifting filter at 16*a* and the manually adjustable gain control G1 indicated at 17. The output of the side channel 12, including the low pass filtered, quadrature phase shifted signal is mixed back into the left and right hand main signal channels by the in-phase inputs of summing and differencing network 60 at the processor output. As in the embodiment of FIG. 2, the relative 90° phase shift network 16*a* is associated with phase shifting filters 16*b* and 16*c* to provide the relative quadrature phase shift in the difference channel. All pass filter 38 and 40 in the sum and difference channels are identical to all pass filters 38 and 40 in the main left and right signal channels of processor 5' of FIG. 2**.

The processor 5'' in FIG. 3 also differs from the above embodiments of FIGS. 1 and 2 in that the gain adjustable anti-phase cross-feed is provided in a somewhat different form by the addition of summing network 70 located in the difference channel between networks 50 and 60 as illustrated, and the relocation of the G2 variable gain control indicated at 72. Variable gain control G2 indicated at 72 is disposed downstream of low pass filter 36 to boost the difference channel signal by an adjustable amount of low pass filtered difference signal at summing network 70. The variable gain G2 provided at 72 controls the amount of low pass filtered difference signal that is ultimately mixed back into the left and right main channels 10 and 11 by output summing and differencing network 60. The net effect is to provide an adjustable amount of anti-phase cross-feed between the main left and right channels as in the case of the G2 gain controls of the processors 5 and 5' shown in FIGS. 1 and 2.

As described below in connection with the preferred form of the invention shown in detail in FIGS. 4 and 5, the low pass filtered, quadrature shifted signal in side channel 12 of FIG. 3, may alternatively be converted in phase and added back into either the sum channel or the difference channel at the output summing and differencing network 60.

Figure 4:
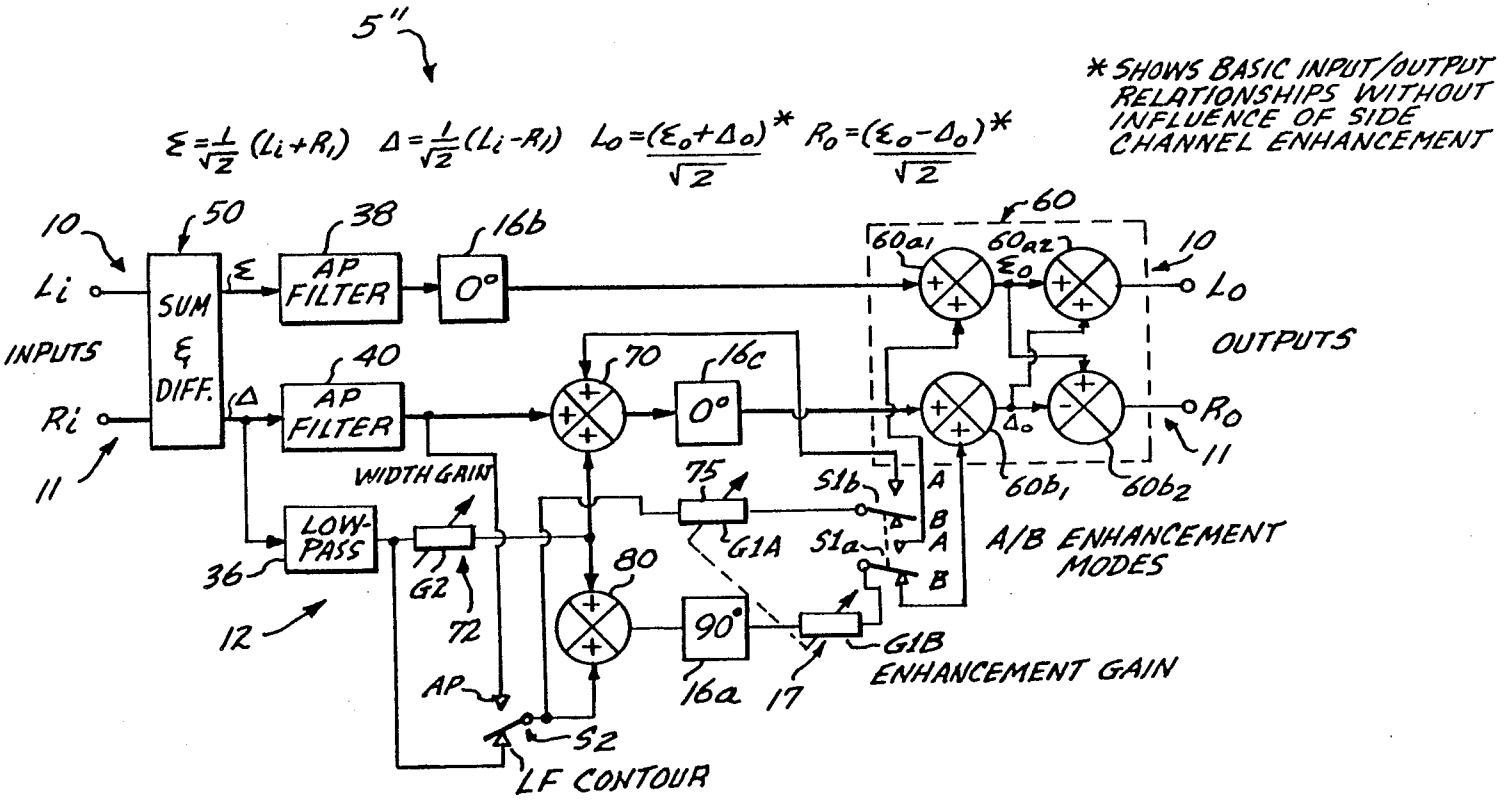
FIG. 4 is a more detailed block and schematic diagram of a processor constructed in accordance with the embodiment of FIG. 3.
Figure 5:
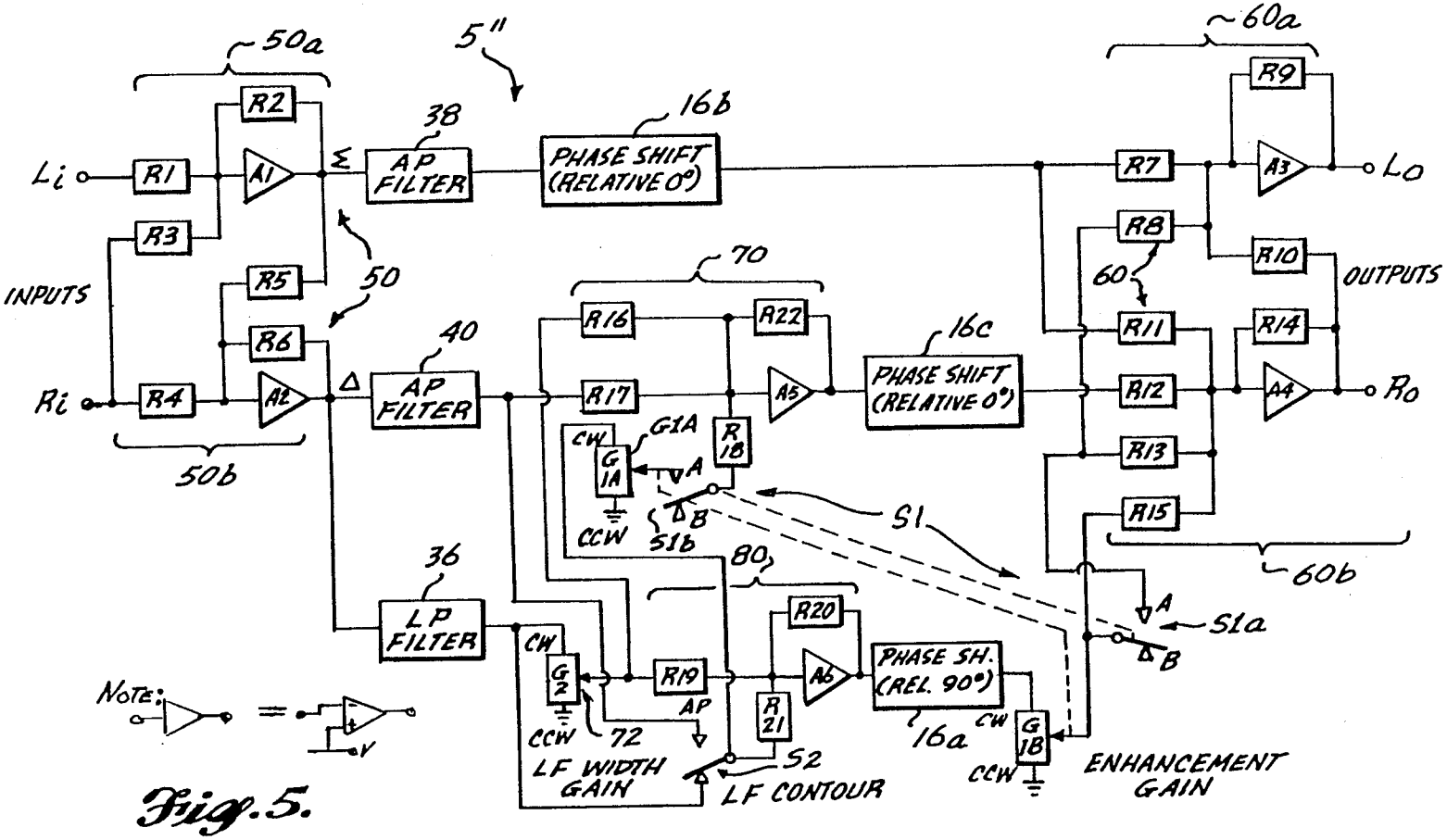
FIG. 5 is a detailed schematic diagram of the processor circuitry corresponding to the embodiment of FIGS. 3 and 4.

FIGS. 4 and 5 depict block and schematic diagrams respectively of the preferred form of processor 5'' introduced above in connection with the more generalized FIG. 3 diagram. First, with reference to FIG. 4, processor 5'' preferably incorporates an A/B enhancement mode selection switch S1, and a low frequency contour switch S2. Switch S1 is a two pole, two position switch in which a first section, S1a, alternately connects the adjustable gain output of the side channel 12 at G1B to either the sum channel (at contact A) or the difference channel (at contact B). The contacts A and B of S1a are shown to be connected into in phase summing networks **60*a*1 and 60*b*1, respectively of the sum and difference channels delta (Δ) and sigma (Σ). In this embodiment, summing junction 60*a*1 and 60*b*1 are integrated into the summing and differencing network 60 and thus precede the summing and differencing junction 60*a*2 and 60*b*2 of network 60 as best shown in the more detailed schematic diagram of FIG. 5**, described below.

The enhancement gain signal of side channel 12 is, in this embodiment, varied in gain by one of a pair of ganged potentiometers indicated at 17 as G1B which receives the quadrature shifted enhancement signal from 90° phase shifting network 16*a*.

Ganged to the enhancement gain control potentiometer G1B is another potentiometer G1A indicated at 75 which is connected to switch pole S1b to provide an in phase boost to the signal in the difference channel when switch S1 is in the A enhancement mode position. It is observed that the signal passing through potentiometer control G1A at 75 is not phase shifted relative to the main sum and difference channels. Rather, it receives the difference signal either through low pass filter 36 or all pass filter 40 upstream of phase shifting network 16*a*. In the B enhancement mode position of switch S1, the switch section S1b terminates the G1A gain control at an unused contact B as indicated. Thus in the B enhancement mode, the G1A variable gain boost in the difference channel is inoperative.

The other control switch S2 of processor 5" as shown in FIG. 4, allows the user to select either a low pass filtered or all pass difference signal, respectively at the LF and AP contacts as illustrated. Thus in the LF position of S2, the difference signal from the summing and differencing network 50 is limited to the frequency components, such as below 2 kilo Hz at low pass filter 36. This low pass filter difference signal is then communicated through switch S2 into summing network 80, the output of which is fed to the 90° phase shifting filter 16*a*.

In the AP position of switch S2, the 90° phase shift side channel difference signal is derived from the output of all pass filter 40 as indicated and thus the enhancement function is not in this case limited to the lower frequency components of the stereo signal.

As shown at the top of FIG. 4, the sum and difference signals resulting from the summing and differencing network 50 are proportional to the sum and difference, respectively, of the stereo input components Li and Ri, by factor of 1 divided by the square root of 2. The output stereo signal components Lo and Ro contain a certain amount of cross-feed from both channels as indicated by the relationship shown at the top of FIG. 4 in which both the left and right outputs contain some signal components of both the sum and difference signal values $\Sigma o$ and $\Delta o$. These relationships hold true when the influence of the side channel enhancement is ignored or gain controls G1 and G2 are turned to 0 gain The same relationships are know per se from the teachings of Allen Blumlein disclosed in British Patent No. 394,325, and are provided by the cascading of an input summing and differencing network 50 and an output summing and differencing network 60, without the additional summing input signals from side channel 12 at summing junction 60*a*1 and 60*b*1 provided by this invention. However, I have found that the enhancement effect provided by the quadrature shifted difference signal in side channel 12 when added back into the sum and difference signal paths as described herein, provide a unique interaction of effects that is not provided by the summing and differencing network 50 and 60 per se.

Now with regard to FIG. 5, additional schematic detail is shown for the preferred embodiment of processor 5". Thus the summing portion of summing and differencing network 50 is shown to be provided by an amplifier A1 connected with input resistors R1 and R3 and a feedback resistor R2; and the differencing portion of network 50 is provided by amplifier A2 connected with input resistors R4 and R5 and a feedback resistor R6, wherein resistors R3 and R5 provide the necessary cross-channel feed to form the sum and difference signal outputs. Similarly, network 60 is shown to have a summing portion 60*a* including an amplifier A3, input resistors R7, R8 and R10 and a feedback resistor R9. The difference portion of network 60 is shown to be provided by an amplifier A4, input resistors R11, R12, R13 and R15 and a feedback resistor R14, all of which are connected in a manner well known per se to provide the relative summing and differencing functions described above in connection with the block diagram of network 60 in Figure 4.

Summing network 70 includes amplifier A5 connected with a feedback resistor R22 and input resistors R16, R17 and R18 for summing the input signals as described above and adding the results into the difference channel passing from the output of network 50 to the input of network 60. Finally, the summing network 80 is shown to be provided by an amplifier A6, feedback resistor R20 and input resistors R19 and R21 to sum the outputs from the S2 low frequency contour selection switch with a variable width gain output from potentiometer G2 at 72.

Operation

The preferred embodiment shown as processor 5" in FIGS. 4 and 5 provide different modes of enhancement depending on the settings of G1, G2 and S1 and S2. In use, it is recommended that the processor be initially set with both the enhancement gain (G1A, G1B) and the width gain (G2) turned fully counterclockwise to a 0 gain positions. The low frequency contour switch S2 should be set in the all pass position and the A/B enhancement mode selection switch S1 is set in the B position.

Now, the enhancement gain is increased by rotating G1B toward a clockwise position. The enhancement is pleasing but difficult to describe; it seems to cause the image to have a spatial clarity in which a greater amount of the original signal information appears to be recovered. This is especially so of quickly decaying transients and harmonic partials. Reverberation returns sound more discrete and there is a greater sense of spatial positioning of the sound sources, i.e., the ability to discern where the pick-up microphones were located relative to the original performance. In some music, the all pass enhance mode may cause muddling of the sound in the upper bands. By switching the S2 to the LF contour position, the enhancement mode is limited to the low pass frequencies of 2 kilo Hz and below, thereby reducing the immediately above described effect.

When S1 is switched to the A mode and the enhancement gain is increased, the image may tend to noticeably narrow even though the other desirable effects of the enhancement are still present. To overcome this narrowing of the image, the ganged potentiometer control G1A adds variable in-phase gain boost (not shifted by phase shifter 16*a*) in the difference channel to even out the different effect. Also, the image widening effect of the G2 gain control can be used in either the A or B modes to compensate for image narrowing that may occur with the enhancement gain. The relative settings of the enhancement gain G1A, G1B and the width gain G2 will vary depending upon the music source and listener. Normally, best results are obtained by combining both the enhancement gain G1 with the width broadening gain G2.

The type B enhancement mode is particularly effective for use with headphones, but it is also useful for livening up recordings made with pick-ups having back-to-back cardioids gain patterns. In mode B, there tends to be a greater separation of the sound image in the middle of the stereo stage.

The mode selection switch S1 is also useful in setting processor 5" so as to be compatible with systems requiring stereo to monaural combining, such as for broadcast or recording purposes. By setting switch S1 to the A mode, processor 5" can be used when the outputs Lo and Ro are combined into a monaural signal. This operation, sometimes called mono-ing, is especially effective for certain types of encoded stereo signals such as Dolby (trademark).

Also, the processor is compatible with a monaural source signal applied jointly to the processor inputs. In such case, the enhancement does not effect the monaural signal because the differencing signal tends to drop to zero level. This effect can be very useful for certain broadcasting, record cutting and sound track recovery applications in which compatibility between stereo and monaural systems is required.

In general, the processor in accordance with the present invention is useful in a wide variety of audio recording, broadcasting and reproduction applications. It is particularly useful during the original recording of live performances in which the various sound tracks are mixed in a manner, such as by the use of "panpots" which tend to concentrate the original signal information in the dominant opposed phase regions of the phase circle. This can occur during mixing, sub-mixing and mastering processes. The invention is also useful for enhancing prerecorded stereo music, such as in the use of professional and consumer audio equipment for reproducing recorded sound or receiving broadcasts.

While the invention has been described with reference to certain preferred and alternative embodiments, it will be appreciated that numerous modifications and changes can be made to these embodiments without departing from the principles of the invention. For example, the processors described above in connection with FIGS. 1–5 have been disclosed as analog circuits. It will be appreciated that the principles of differencing and quadrature phase shifting of the side channel signal can also be performed using digital processes operating on digitized stereo signal inputs. Thus the invention is applicable to audio signal processing systems that are partly or wholly digitized.

I claim:

1. A signal enhancement processor for enhancing stereo audio, comprising:

a first main channel having an input for receiving one spatial component of an audio stereo signal and having an output for producing a first modified stereo component signal;

a second main channel having an input for receiving another spatial component of the audio stereo signal and an output for producing a second modified stereo component having spatial content different from said first modified stereo component;

a side channel for enhancing the audio stereo signal;

a signal differencing means for feeding to said side channel a difference signal derived from said first and second main channels, said signal differencing means causing said difference signal to approach zero when a monaural signal is received at said inputs of said first and second main channels, and wherein said side channel comprises phase shifting means for producing a quadrature phase shift of the difference signal relative to the signals in said first and second main channels; and signal combining means for combining the quadrature shifted difference signal in said side channel back into said first and second main channels the system allowing a monaural signal applied to said first and second main channel inputs to pass through to the respective outputs substantially unchanged.

2. The processor of claim 1 wherein said means for combining the quadrature shifted difference signal comprises first and second summing means in said first and second main channels respectively, and in which the output of said side channel is jointly fed into said first and second summing means so as to combine the quadrature shifted difference signal into both of said first and second main channels prior to the outputs thereof.

3. The processor of claim 1 further comprising:

said first and second main channels having an input sum and difference network means and an output sum and difference network means cascaded between said inputs and outputs;

said input sum and difference network means connected to said inputs of said first and second main channels for producing summed signal components and difference signal components; and said output sum and difference network means connected for receiving the summed signal components and the difference signal components and for converting same into said modified stereo component signals at said outputs of said first and second main channels, and wherein said signal differencing means for feeding said difference signal to said side channel is provided by said input sum and difference network means at an output thereof at which said difference signal components are produced.

4. The processor of claim 1 further comprising:

means for cross-feeding opposed phase portions of the stereo component signals between said first and second mean channels.

5. The processor of claim 1 wherein said side channel further comprises:

variable gain control means in said side channel for adjusting the amplitude of the quadrature shifted difference signal.

6. A signal enhancement processor for stereo audio, comprising:

sum channel means for conducting signals representing the sum of left and right spatial signal components of a stereo signal;

difference channel means for conducting signals representing the difference of said left and right spatial signal components of said stereo signal;

enhancement channel means having an input connected to said difference channel and having at least one output connected to either said sum channel or said difference channel; and means for producing a relative phase shift of a signal in said enhancement channel means that is substantially in quadrature relative to said signals in said sum channel means and said difference channel means, and wherein said phase shift remains substantially constant with frequency over a predetermined frequency range of said stereo signal.

7. A method of enhancing the listening enjoyment of stereo audio, comprising the steps of:

processing sum and difference signals representing respectively the sum and difference of left and right spatial signal components of said stereo audio by extracting a third signal from said difference signal channel, and introducing a substantially quadrature phase shift of said third signal relative to said sum and difference signals, said substantially quadrature phase shift being generally constant over a range of frequencies existing in said stereo audio, and recombining the phase shifted third signal with said sum signal or said difference signal.

8. A processor for enhancing stereo images by processing the left and right spatial signal components of a stereo signal, comprising:

first and second inputs for respectively receiving the left and right spatial signal components of a stereo signal, and first and second outputs at which enhanced left and right stereo signal components are produced;

an input and difference network connected to said first and second inputs an having a sum signal channel in which a sum signal is produced representing the sum of the left and right spatial signal components, and a difference signal channel in which a difference signal is produced representing the difference of the left and right spatial signal components;

a side channel connected to receive said difference signal from said difference channel and having a low pass filter means, a quadrature phase shifting means for shifting the phase of the signal in the side channel in quadrature relative to the sum and difference signals, and manually controllable gain adjusting means for adjusting the gain of the signal in said side channel prior to an output thereof;

an output sum and difference network having a sum input connected to said sum signal channel and having a difference input connected to said difference signal channel, and having means providing said first and second outputs; and combining means for summing the output of said side channel with either the sum signal channel or difference signal channel prior to said output sum and difference network.

9. The processor of claim 8 wherein said combining means comprises switching means for selectively switching the output of said side channel so as to be selectively combined with either the sum signal channel or the difference signal channel.

10. The processor of claim 9 further comprising:

switching circuit means for selectively connecting the quadrature phase shifting means of the side channel to said difference signal channel so as to selectively bypass said low pass filter means.

11. The processor of claim 10 further comprising:

circuit means for selectively providing a manually variable in-phase gain boost to signals in the difference signal channel when said combining means combines the output of said side channel with the sum signal channel.

12. The processor of claim 11 further comprising phase compensation circuit means connected to pass the sum and difference signal components between said input and output sum and difference networks so as to maintain the quadrature phase shift of the signal at the output of said side channel, relative to said sum and difference signal channels, substantially constant with change in frequency.

13. A signal enhancement processor for stereo audio comprising:

a first main channel having an input for receiving one spatial component of an audio stereo signal and having an output for producing a modified stereo component signal;

a second main channel having an input for receiving another spatial component of the audio stereo signal and an output for producing another modified stereo component;

a side channel or enhancing the audio stereo signal;

a signal differencing means for feeding to said side channel a difference signal derived from said first and second main channels, and wherein said side channel comprises phase shifting means for producing a quadrature phase shift of the difference signal relative to the signals in said first and second main channels, and low pass filter means in said side channel means for low pass filtering said difference signal; and signal combining means for combining the quadrature shifted difference signal in said side channel back into said first and second main channels.

14. The processor of claim 13 further comprising:

low pass filter means in said channel means for low pass filtering said difference signal.

15. The processor of claim 14 wherein said low pass filter means has an upper frequency limit of about 2 Kilo Hz.

16. A signal enhancement processor for stereo audio comprising:

a first main channel having an input for receiving one spatial component of an audio stereo signal and having an output for producing a modified stereo component signal;

a second main channel having an input for receiving another spatial component of the audio stereo signal and an output for producing another modified stereo component;

a side channel for enhancing the audio stereo signal;

a signal differencing means for feeding to said side channel a difference signal derived from said first and second main channels, and wherein said side channel comprises phase shifting means for producing a quadrature phase shift of the difference signal relative to the signals in said first and second main channels;

signal combining means for combining the quadrature shifted signal in said side channel back into said first and second main channels;

said first and second main channels having an input sum and difference network means nd an output sum and difference network means cascaded between said inputs and outputs;

said input sum and difference network means connected to said inputs of said first and second main channels for producing summed signal components and difference signal components;

said output sum and difference network means connected for receiving the summed signal components and the difference signal components and for converting same into said modified stereo component signals at said outputs of said first and second main channels; and wherein said signal differencing means for feeding said difference signal to said side channel is provided by said input sum and difference network means at an output thereof at which said difference signal components are provided.

* * * * *